US007481170B2

(12) United States Patent
Sommerfield

(10) Patent No.: US 7,481,170 B2
(45) Date of Patent: Jan. 27, 2009

(54) ACCESSORY SHELF MOUNTING MECHANISM

(75) Inventor: Matthew Sommerfield, Allentown, PA (US)

(73) Assignee: Humanscale Corporation, New York, NY (US)

( * ) Notice: Subject to any disclaimer, the term of this patent is extended or adjusted under 35 U.S.C. 154(b) by 140 days.

(21) Appl. No.: 11/198,407

(22) Filed: Aug. 5, 2005

(65) Prior Publication Data

US 2007/0028815 A1 Feb. 8, 2007

(51) Int. Cl.
*A47B 11/00* (2006.01)

(52) U.S. Cl. ..... 108/103; 108/50.02

(58) Field of Classification Search ..... 108/94, 108/103, 137, 139, 140, 50.01, 50.02; 248/224.7, 248/222.51, 222.52; 403/96, 92, 94; 312/208.1, 312/223.3

See application file for complete search history.

(56) References Cited

U.S. PATENT DOCUMENTS

| | | | | |
|---|---|---|---|---|
| 2,468,473 | A | 4/1949 | Underwood | |
| 3,045,271 | A * | 7/1962 | Cinotti | 15/235.8 |
| 3,255,719 | A | 6/1966 | Klavins | |
| 4,733,618 | A * | 3/1988 | Sarro et al. | 108/140 |
| 4,844,388 | A * | 7/1989 | Kuba et al. | 108/5 |
| 4,863,124 | A * | 9/1989 | Ball et al. | 108/28 |
| 5,067,692 | A * | 11/1991 | Nudd et al. | 254/420 |
| 5,562,049 | A * | 10/1996 | Hoffman et al. | 108/94 |
| 5,622,118 | A * | 4/1997 | Rowan | 108/65 |
| 5,771,814 | A | 6/1998 | Clausen | |
| 5,832,840 | A * | 11/1998 | Woof | 108/6 |
| 5,842,425 | A * | 12/1998 | van der Aa | 108/64 |
| 5,924,807 | A | 7/1999 | Ambrose et al. | |
| 5,931,103 | A | 8/1999 | Huang | |
| 6,264,156 | B1 | 7/2001 | Yeh | |
| 6,296,215 | B1 | 10/2001 | McCoy et al. | |
| 6,505,566 | B1 | 1/2003 | Foster et al. | |
| 6,526,896 | B2 | 3/2003 | Woronecki et al. | |
| 6,823,805 | B2 * | 11/2004 | Becker | 108/103 |

* cited by examiner

*Primary Examiner*—Janet M Wilkens
(74) *Attorney, Agent, or Firm*—Jones, Walker, Waechter, Poitevent, Carrere & Denegre, LLP

(57) ABSTRACT

A mounting mechanism useful for swivelly attaching a secondary work surface, such as a computer mouse platform or other accessory work shelf, to a primary work surface, such as a computer keyboard platform or a table or desk, and furniture, such as computer support furniture, having an accessory work shelf swivelly attached to a primary work surface. The mounting mechanism facilitates swivel movement of the accessory work shelf relative to the primary work surface while maintaining a constant but easily adjustable tension. A method for attaching both of said accessory work shelf and said primary work surface to a mounting mechanism.

21 Claims, 4 Drawing Sheets

ACCESSORY SHELF MOUNTING MECHANISM

FIELD OF THE INVENTION

The present invention relates to a mechanism that is useful for mounting a work surface, such as an accessory shelf, to another work surface. The invention also relates to furniture, such as computing furniture, having one work surface mounted to another work surface.

BACKGROUND

The use of computer accessory items, such as a computer mouse, personal digital assistant (PDA), miniature video camera, or MP3 player, is common for most computer users. Placement of such items in relation to a primary work surface, such as a desktop or a table for holding a keyboard, can vary greatly among computer users. Further, constant and continual movement of the user's hand to move accessory items, particularly a computer mouse, while operating a computer keyboard can be required and can be tiring and stressful to the user. One response to these problems has been to provide a computer accessory shelf that can be mounted to a primary work surface and move relative to the primary work surface.

Accessory shelves mounted to provide rotatable motion are generally plagued by multiple drawbacks. For example, it is desirable for the accessory shelf to be rotatable to a given position and then maintain that position; however, re-positioning of the shelf tends to loosen such shelves making position maintenance difficult. Further, it is generally difficult to adjust the tension of the shelves to make it harder or easier to rotate. Still further, the hardware used to attach such shelves is often bulky, protruding above or below the shelf.

It is therefore an object of the invention to provide a mechanism for swivelly mounting an accessory work shelf to a primary work surface, such as a keyboard tray.

It is another object of the invention to provide a mechanism for mounting an accessory work shelf to a primary work surface to allow swivel motion relative to the primary work surface while maintaining a consistent tension that will not loosen due to rotation of the accessory shelf.

It is still another object of the invention to provide a mechanism for swivelly mounting an accessory work shelf to a primary work surface wherein the resistance to the swivel motion can be adjusted easily by the user.

These and other objects, features, and advantages of the present invention will become apparent to persons familiar with structures of this general type from the following discussion and drawings.

SUMMARY OF THE INVENTION

The present invention provides a mechanism for mounting an accessory work shelf, or platform, to another work surface. The mechanism allows for rotational, or swivel, movement of the accessory shelf relative to the other work surface. The mechanism allows for movement of the accessory shelf while maintaining a consistent but easily adjustable tension.

In one embodiment, the invention is a mechanism for swivelly mounting an accessory shelf to a primary work surface, such as a keyboard tray. The mechanism generally comprises a spacer component, a friction inducing component, a tension adjustment component, and a spacer antirotation component. The spacer component has a top portion for interacting with the primary work surface and bottom portion for interacting with the accessory work shelf.

In one particular embodiment, the spacer component is a bushing generally having a thickened, disk-like shape. The spacer component includes multiple apertures for facilitating attachment of additional mechanism components, such as the friction inducing component, and attachment to the accessory work shelf and the primary work surface.

In another embodiment, the invention is a computer work table comprising a primary work surface and an accessory work shelf. The accessory work shelf is swivelly mounted to the primary work surface with a mounting mechanism comprising a spacer bushing, a friction inducing component, and a tension adjustment component. In a particular embodiment, the mounting mechanism further comprises an antirotation component. A top portion of the spacer bushing is in contact with the primary work surface and a bottom portion of the spacer bushing is in contact with the accessory work shelf.

Preferentially, the accessory work shelf includes an aperture sized for receiving the bottom portion of the spacer bushing, with at least a portion of the spacer bushing resting on a top surface of the accessory shelf. According to this embodiment, the friction inducing component can be placed on a bottom surface of the accessory work shelf and attached to the spacer bushing with the tension adjustment component. In one particular embodiment, the tension adjustment component is a screw, and the tension applied between the friction inducing component and the spacer bushing (and, therefore, the amount of force required to impart a swivel movement to the accessory work shelf) can be increased or decreased by tightening or loosening the tension adjustment screw.

According to another embodiment, the invention is a mechanism for swivelly mounting an auxiliary work shelf to a primary work surface, wherein the mechanism comprises a spacer bushing having a top portion for interacting with the primary work surface and a bottom portion for swivelly interacting with the accessory work shelf, a friction washer attached to the spacer bushing, a tension adjustment screw for attaching the friction washer to the spacer bushing, and one or more spacer bushing antirotation pins for maintaining the mechanism in a constant position relative to the primary work surface.

According to another aspect of the invention, there is provided a method for swivelly mounting an accessory work shelf to a primary work surface. In one embodiment, the method comprises attaching both of the accessory shelf and the primary work surface to a mounting mechanism comprising a spacer bushing, a friction inducing component, a tension adjustment component, and an antirotation component.

DETAILED DESCRIPTION OF THE INVENTION

The present invention will now be described more fully hereinafter with reference to the accompanying drawings, in which some, but not all embodiments of the invention are show. The present invention may be embodied in many different forms and should not be construed as limited to the embodiments set forth herein; rather, these embodiments are provided so that this disclosure will satisfy applicable legal requirements. Like numbers refer to like elements throughout. As used in this specification and the claims, the singular forms "a," "an," and "the" include plural referents unless the context clearly dictates otherwise.

The invention provides a mechanism for swivelly mounting an accessory work shelf to a primary work surface and also provides furniture, such as computer tables, incorporating the mechanism. The mounting mechanism of the invention is particularly beneficial in that it allows motion of the accessory work shelf relative to the primary work surface while maintaining a consistent but adjustable tension.

The terms "accessory work shelf" and "primary work surface" as used herein are intended to be used in their broadest sense and are not intended to be limited to specific embodiments used as examples herein. A "primary work surface", as used herein, is intended to encompass generally any piece of furniture normally recognized as useful in an office-type setting. For example, a primary work surface could include desks, tables, or similar furniture types providing a generally horizontal surface for supporting computer equipment or allowing for work performed thereon. A primary work surface could also encompass objects, such as computer keyboard trays, that are integrally attached to, or capable of extending from, a larger structure, such as a desk. In computing, a keyboard tray would generally be recognized as a primary work surface as much of the input associated with computing arises from the computer keyboard. Further, a primary work surface could encompass freestanding tables specifically designed for supporting a computer and computer-related equipment. An "accessory work shelf", as used herein, is intended to encompass generally any shelf, platform, or the like that is capable of being attached to another work surface. In the area of computing, such a work shelf is useful for supporting accessory computer items, such as, for example, a computer mouse, PDA, miniature video camera, or MP3 player.

Figure 1:
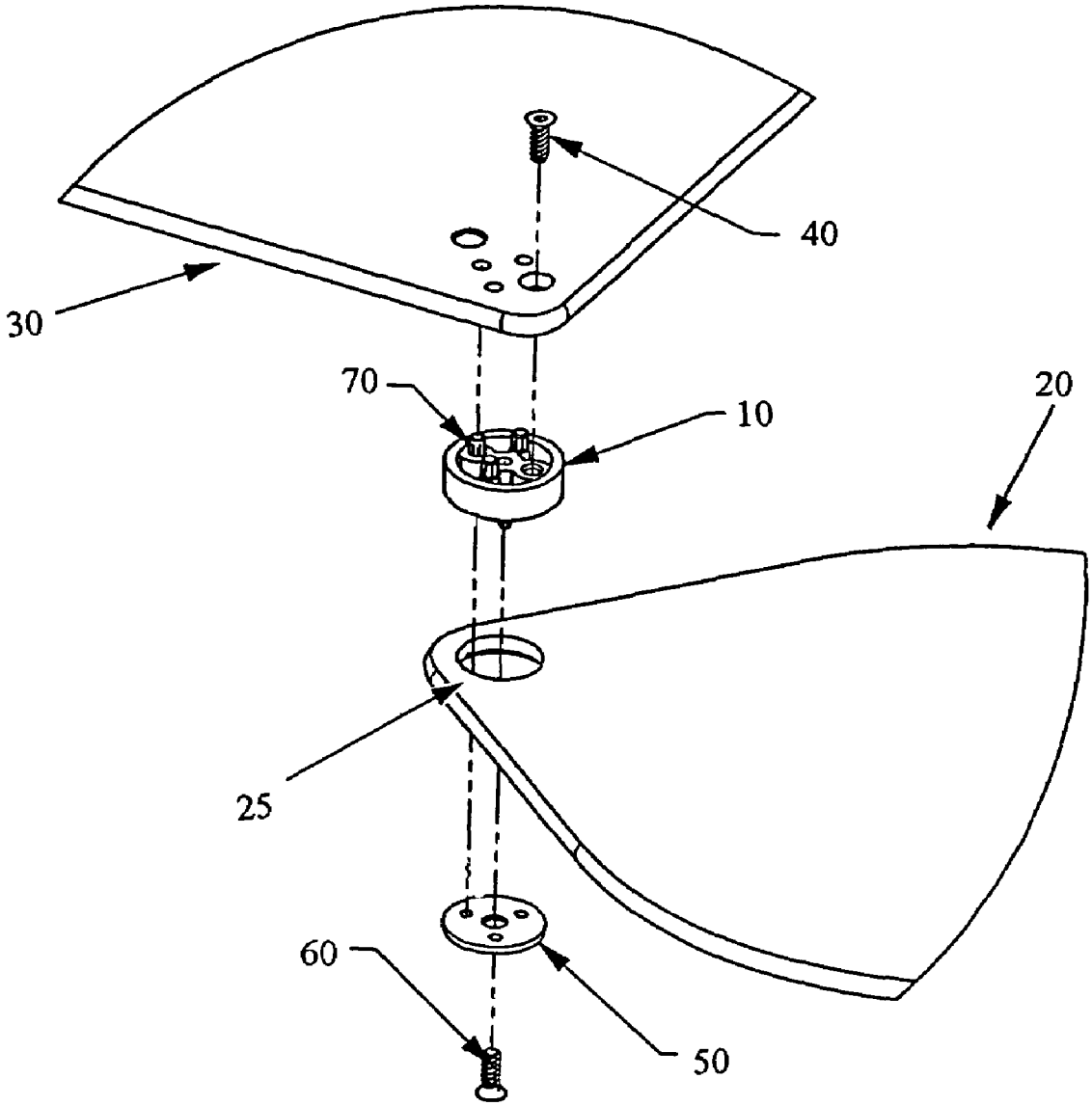
FIG. 1 is an exploded view of a mounting mechanism of the invention in one embodiment wherein the mounting mechanism is in association with a primary work surface and an accessory work shelf.

One embodiment of the mounting mechanism of the invention is shown in FIG. 1, which provides an exploded view of the mounting mechanism to illustrate the various parts of the mechanism in association with a primary work surface and an accessory work shelf. The mounting mechanism includes a spacer component, which forms the body of the mechanism. The spacer component generally includes a top portion for interacting with the primary work surface and a bottom portion for interacting with the accessory work shelf. The spacer component also preferentially includes one or more apertures capable of receiving further components of the mounting mechanism. The apertures are also useful for attaching the mounting mechanism to the primary work surface and to the accessory work shelf. The apertures provided in the spacer component can extend partially or completely through the thickness of the spacer component. When advantageous, the internal walls of the apertures in the spacer component can be threaded, such as useful for receiving screws, bolts, or the like. Alternately, the internal walls of the apertures in the spacer component can be completely or partially smooth, such as useful for receiving pins, rivets, or the like.

Figure 2A:
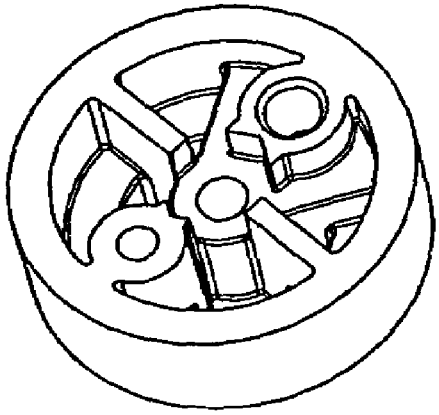
FIG. 2*a* is a top perspective view of a spacer bushing according to one embodiment of the mounting mechanism of the invention.

In the embodiment shown in FIG. 1, the spacer component is a spacer bushing 10 that is generally circular in shape. One particular embodiment of a spacer bushing useful as the spacer component of the mounting mechanism of the invention is more clearly shown in FIGS. 2*a* and 2*b*. As seen in FIG. 2*a*, the spacer bushing is not solid throughout but has, rather, an open structure. While an open structure is not required, it is beneficial for providing a lightweight, strong mounting mechanism. Accordingly, the spacer bushing can be formed from various metals or plastics that are known as useful for providing formed parts. Where plastics are used, it is beneficial for the plastic to exhibit high strength and durability. Further, where metals are used, lightweight metals may be used, but heavier metals, such as steel, can also be used given the open structure of the bushing. In one embodiment, the spacer bushing is formed from a metal, such as aluminum.

Figure 2B:
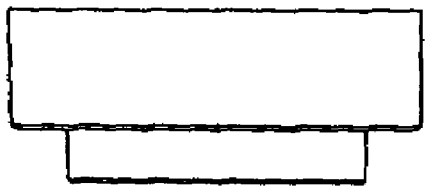
FIG. 2*b* is a side view of a spacer bushing according to one embodiment of the mounting mechanism of the invention.

As seen with the embodiment illustrated in FIG. 2*b*, the bottom portion of the spacer bushing is formed for interacting with an accessory work shelf by having a portion that has a reduced diameter in relation to the diameter of the overall spacer bushing. Preferentially, the diameter is "stepped-down" at the bottom portion of the spacer bushing, thereby forming a lip at the bottom portion of the spacer bushing.

In this embodiment of the invention, the entire spacer bushing is circular in shape; however, such is not required. For example, the bottom portion of the spacer bushing can be circular in shape while the remaining portion of the spacer bushing is non-circular in shape. For example, the upper portion of the spacer bushing could be generally square in shape. Preferentially, regardless of the shape of the upper portion and bottom portion, the width of the upper portion of the spacer bushing is greater than the width of the bottom portion of the spacer bushing.

Referring again to FIG. 1, the top portion of the spacer bushing 10 attaches to the primary work surface 30. In the embodiment shown in FIG. 1, the spacer bushing 10 attaches to the primary work surface 30 with a bushing retaining screw 40; however attachment can be through additional or different components. For example, in addition to screws, other attachment pieces, such as bolts, rivets, and the like could be used. In further embodiments, a threaded insert is molded into the bushing 10. In the embodiment shown in FIG. 1, a single bushing retaining screw 40 is used for attaching the spacer bushing 10 to the primary work surface 30. The bushing retaining screw 40 is placed through an aperture in the primary work surface 30 into an aperture in the spacer bushing prepared for receiving the retaining screw 40.

Figure 4:
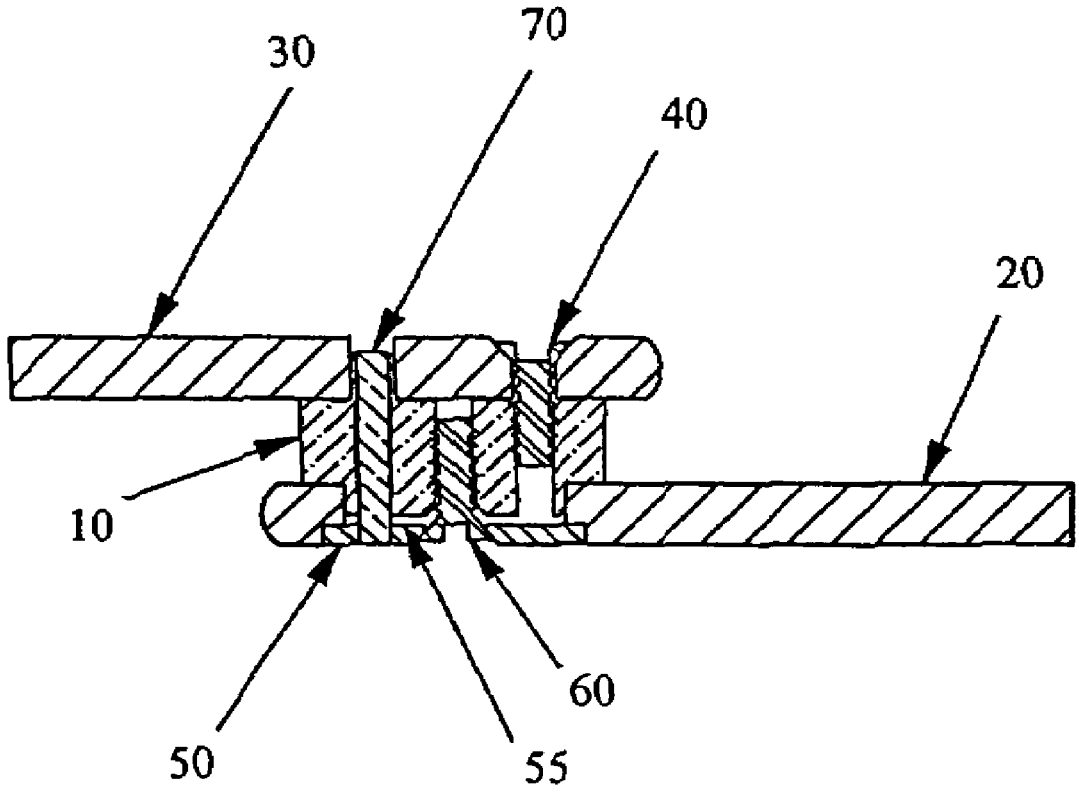
FIG. 4 is a cross-sectional view along line B-B shown in FIG. 3 of one embodiment of the mounting mechanism of the invention.

The spacer bushing 10 also interacts with the accessory work shelf 20, the reduced diameter bottom portion of the spacer bushing 10 fitting into an aperture 25 in the accessory work shelf 20. In this embodiment of the invention, as shown in FIG. 4, the lip on the spacer bushing 10 rests on the top surface of the accessory work shelf 20, and the reduced diameter portion of the spacer bushing 10 fits into the aperture 25 in the accessory work shelf 20. Preferentially, the reduced diameter portion of the spacer bushing 10 is of such a thickness that the reduced diameter portion does not extend completely through the aperture in the accessory work shelf 20.

Referring again to FIG. 4, the accessory work shelf 20 is separated from the primary work surface 30 by a distance approximately the thickness of the upper portion of the spacer bushing 10. Accordingly, the location of the accessory work shelf in horizontal relation to the primary work surface can be altered based upon the thickness of the spacer bushing. In one embodiment, it is preferred for the accessory work shelf to be approximately at the same horizontal position, or slightly below, of the primary work surface. Accordingly, in one embodiment, it is preferable for the spacer bushing to have an overall thickness that is as thin as possible while maintaining sufficient thickness to receive the remaining components of the mounting mechanism. According to another embodiment, it may be preferable for the accessory work shelf to be positioned horizontally a greater distance below the primary surface. In this embodiment, the overall thickness of the spacer bushing can be a thick as possible while still allowing for inclusion of all necessary components of the mounting mechanism.

In addition to the spacer component, the mounting mechanism further includes a friction inducing component. The friction inducing component is attached to the spacer component such that a portion of the accessory work shelf is maintained between the spacer component and the friction inducing component (i.e., the accessory work shelf is sandwiched, or trapped, between the spacer component and the friction inducing component), as shown in FIG. 4. The friction inducing component presses up against the accessory shelf under tension, thereby imparting friction during rotational movement of the accessory work shelf. The presence of the friction inducing component also serves to maintain the accessory work shelf in attachment to the spacer component.

The friction inducing component can be any article capable of being maintained against the accessory work shelf under tension. In the embodiment shown in FIG. 1, the friction inducing component is a friction washer 50. While other items could be used as the friction inducing component, the friction washer 50 is particularly useful in that it provides necessary strength and durability while having a minimal profile. Further, as seen in FIG. 4, the accessory work shelf 20 can be notched (i.e., a recess formed) for receiving the friction washer 50. In this embodiment, no portion of the mounting mechanism extends below the bottom surface of the accessory work shelf 20.

In the embodiment shown in FIG. 4, the reduced diameter portion of the spacer bushing 10 is of a thickness such that the reduced diameter portion extends only partially into the aperture in the accessory work shelf 20, and the lip of the spacer bushing 10 rests on the top surface of the accessory work shelf 20. The recess for receiving the friction washer 50 is generally a depth equal to the thickness of the friction washer 50, such that the washer fits flush with the bottom surface of the accessory work shelf. It is not necessary, however, that the friction washer 50 be recessed.

As further seen in the embodiment of FIG. 4, the reduced diameter portion of the spacer bushing 10 fits into the aperture in the accessory shelf 20, and the friction washer 50 is recessed in the bottom surface of the accessory shelf 20 such that the friction washer 50 is not in actual physical contact with the spacer bushing 10, and a gap 55 is maintained between the spacer bushing 10 and the friction washer 50. Maintenance of the gap 55 between the friction washer 50 and the spacer bushing 10 is beneficial for creating a constant friction on the accessory work shelf 20 during swivel movement of the accessory work shelf 20.

The tension on the friction inducing component in pressing against the accessory work shelf can be adjusted along a range from the accessory work shelf swiveling freely to the accessory shelf swiveling with much resistance. Accordingly, the mounting mechanism further comprises a tension adjustment component that can include any device capable of changeably imparting tension on the friction inducing component against the accessory work shelf.

In one embodiment, as seen in FIG. 1, the tension adjustment component can include a tension adjustment screw 60. The tension adjustment screw 60 is inserted through an aperture in the friction washer 50 into an aperture in the spacer bushing 10 formed for receiving a screw. In this manner, the tension on the friction washer 50, and therefore the amount of force required to impart a swivel motion to the accessory work shelf 20, can be adjusted by tightening or loosening the tension adjustment screw 60. This arrangement is particularly beneficial in that the attachment of the friction washer 50 to the spacer bushing 10 by the tension adjustment screw 60 is independent of the accessory work shelf 20. Accordingly, the tension provided by the tension adjustment screw 60 is less prone to inadvertent adjustment by the swivel movement of the accessory work shelf 20.

Figure 3:
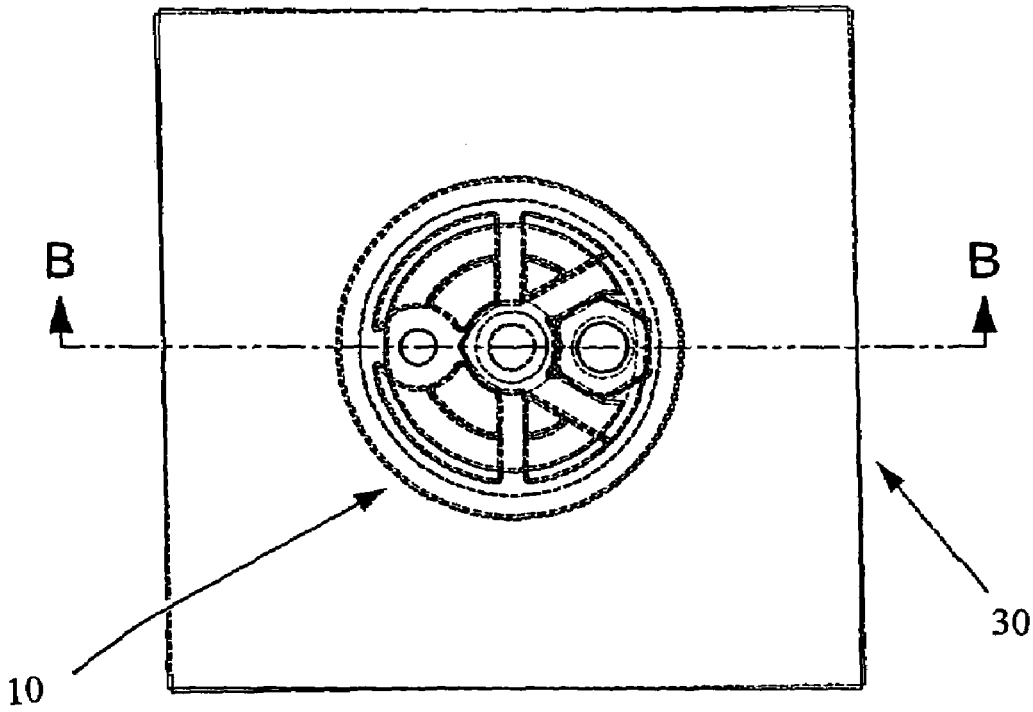
FIG. 3 is a top view of a mounting mechanism of the invention attached to a primary work surface, with the primary work surface being transparent.

As noted above, the swivel movement of the accessory work shelf is relative to the primary work surface. Accordingly, it is preferred that the mounting mechanism be positionally stable (i.e., does not swivel relative to the primary work surface). In one embodiment of the invention, the mounting mechanism further comprises one or more antirotation components. The antirotation component can include any device that can be used in connection with the remaining components of the mounting mechanism to eliminate possible rotation of the mounting mechanism in association with swivel movement of the accessory work shelf. For example, in one embodiment of the invention shown in FIG. 3, the spacer bushing includes three apertures. The rightmost aperture is for receiving a bushing retaining screw for securing the spacer bushing to the primary work surface. The center aperture is for receiving the tension adjustment screw for securing the friction washer to the spacer busing and adjusting the tension on the friction washer. The leftmost aperture is for receiving an antirotation component. The antirotation component can be, for example, a pin, screw, bolt, rivet, or other like piece capable of extending through the primary work surface into the aperture in the spacer bushing. In one embodiment, the antirotation component is specifically a pin.

Without the antirotation component, the spacer bushing is secured to the primary work surface at only a single point (in the embodiment of FIG. 1, the bushing retaining screw). Where the spacer bushing is attached to the primary work surface at a single point, when a swivel movement is imparted to the accessory work shelf, the point of attachment can become a swivel point. Accordingly, the possibility exists for rotation of the spacer bushing around the single pivot point. The inclusion of the antirotation component, such as a pin, provides a second pivot for the spacer bushing spaced apart from the bushing retaining screw, eliminating the possibility of rotation of the spacer bushing in relation to the primary work surface.

As shown in FIG. 4, in one embodiment of the invention, the antirotation component is an antirotation pin 70 extending through an aperture in the primary work surface 30, through an aperture in the spacer bushing 10, and through a corresponding aperture in the friction washer 50. This arrangement is particularly beneficial for further eliminating the possibility of inadvertent tension adjustment by swivel movement of the accessory work shelf 20. In other words, swivel movement of the accessory work shelf 20 will not cause rotation of the friction washer 50 (and, therefore, rotation of the tension adjustment screw 60) because the friction washer 50 is connected to the spacer bushing 10 by the tension adjustment screw 60 and stabilized by the antirotation pin 70. Accordingly, the tension on the accessory work shelf 10 remains constant throughout use of the accessory work shelf 20 unless adjusted by intentionally loosening or tightening the tension adjustment screw 60.

It may be beneficial to include more than one antirotation component. In such case, the antirotation components may be the same type of device, or different devices may be used. In one embodiment shown in FIG. 1, three antirotation pins 70 are used.

In further embodiments of the invention, antirotation and attachment of the spacer bushing to the primary work surface may be facilitated simultaneously according to the method of attachment. For example, the spacer bushing could be permanently attached to the primary work surface, such as through gluing. Alternately, in the case of metal components, the spacer bushing could be soldered or welded to the primary work surface.

The mounting mechanism of the invention is particularly useful in constructing or adapting furniture, such as computer support furniture, to include an accessory work shelf swivelly attached thereto. In particular, the invention provides a computer work table comprising a primary work surface and an accessory work shelf swivelly attached thereto with a mounting mechanism as described herein. Such a computer work table, in one embodiment, includes a desktop having an accessory work shelf swivelly attached thereto. In another embodiment, the computer work table includes a computer keyboard tray having an accessory work shelf swivelly attached thereto.

The invention also encompasses a method of swivelly attaching an accessory work shelf to a primary work surface using the mounting mechanism described herein. The method comprises attaching the mounting mechanism to the primary work surface and attaching the mounting mechanism to the accessory work shelf. The attachment to the primary work surface and to the accessory work shelf can be as previously described herein.

Many modifications and other embodiments of the inventions set forth herein will come to mind to one skilled in the art to which these inventions pertain having the benefit of the teaching presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A mechanism for swivelly mounting an accessory work shelf to a primary work surface comprising:

a. a primary work surface;

b. an accessory work shelf;

c. a spacer component attached to said primary work surface such that said primary work surface does not rotate in relation to said spacer component;

d. a tension adjustment component;

e. a friction inducing component attached to said spacer component by said tension adjustment component to adjustably impart friction to said accessory work shelf during rotational movement of said accessory work shelf, said accessory work shelf being located between said friction inducing component and said spacer component; and f. one or more antirotation pins engaging at least said spacer component and said primary work surface.

2. The mechanism of claim 1, wherein said spacer component comprises a spacer bushing.

3. The mechanism of claim 1, wherein said spacer component comprises a bottom portion having a circular shape.

4. The mechanism of claim 1, wherein said friction inducing component comprises a washer.

5. The mechanism of claim 1, wherein said tension adjustment component comprises a screw.

6. A computer work table comprising:

a. a primary work surface; and b. an accessory work shelf having a top surface and a bottom surface, said accessory work shelf being swivelly mounted to said primary work surface with a mounting mechanism comprising:

i. a spacer bushing having a top portion in contact with said primary work surface and a bottom portion in contact with said accessory work shelf;

ii. a friction inducing component having a top portion in contact with said accessory work shelf;

iii. a tension adjustment component connecting said friction inducing component to said spacer bushing; and iv. one or more antirotation pins engaging at least said spacer bushing and said primary work surface.

7. The computer work table of claim 6, wherein said mounting mechanism is attached to said primary work surface with a retaining screw extending through an aperture in said primary work surface into an aperture formed for receiving a retaining screw in said spacer bushing.

8. The computer work table of claim 6, wherein said bottom portion of said spacer bushing has a reduced diameter in relation to said top portion of said spacer bushing, thereby forming a lip on said spacer bushing.

9. The computer work table of claim 8, wherein said accessory work shelf includes an aperture capable of receiving said reduced diameter portion of said spacer bushing.

10. The computer work table of claim 8, wherein said lip on said spacer bushing is in contact with said top surface of said accessory work shelf.

11. The computer work table of claim 6, wherein said bottom surface of said accessory work shelf includes a recess capable of receiving said friction inducing component.

12. The computer work table of claim 6, wherein a gap is maintained between said spacer bushing and said friction inducing component.

13. The computer work table of claim 6, wherein said tension adjustment component comprises a screw.

14. The computer work table of claim 13, wherein said tension adjustment screw extends through an aperture in said friction inducing component into an aperture in said spacer bushing.

15. The computer work table of claim 6, wherein said one or more antirotation pins extend through corresponding apertures in each of said primary work surface, said spacer bushing, and said friction inducing component.

16. The computer work table of claim 6, wherein said spacer bushing is maintained in a fixed position relative to said primary work surface.

17. The computer work table of claim 6, wherein said friction inducing component is maintained in a fixed position relative to said primary work surface.

18. The computer work table of claim 6, wherein said accessory work shelf is rotatable relative to said primary work surface.

19. The computer work table of claim 6, wherein said primary work surface includes a keyboard tray.

20. The computer work table of claim 6, wherein said accessory work shelf includes a mouse platform.

21. The computer work table of claim 6, wherein said primary work surface includes a desk.

* * * * *